US007080948B2

(12) United States Patent
Kang

(10) Patent No.: US 7,080,948 B2
(45) Date of Patent: Jul. 25, 2006

(54) PAPER EJECTING MECHANISM AND INK-JET PRINTER HAVING THE PAPER EJECTING MECHANISM

(75) Inventor: Sung-wook Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/669,339

(22) Filed: Sep. 25, 2003

(65) Prior Publication Data

US 2004/0100545 A1 May 27, 2004

(30) Foreign Application Priority Data

Nov. 27, 2002 (JP) ..... 10-2002-0074358

(51) Int. Cl.
*B41J 11/58* (2006.01)

(52) U.S. Cl. ..... 400/625; 271/213

(58) Field of Classification Search ..... 400/647.1, 400/637.6, 637.2, 625, 647, 646, 628; 347/104, 347/9; 270/58.08; 271/189, 213, 214
See application file for complete search history.

(56) References Cited

U.S. PATENT DOCUMENTS 4,211,499 A * 7/1980 Hunt et al. ..... 400/637.6
4,844,633 A * 7/1989 Greenberg ..... 400/625
5,177,547 A * 1/1993 Kanemitsu et al. ..... 399/397
5,324,020 A * 6/1994 Rasmussen et al. ..... 271/189
5,534,894 A * 7/1996 Hirano et al. ..... 346/134
5,730,537 A 3/1998 Kelly et al.
5,890,822 A * 4/1999 Saikawa et al. ..... 400/647.1
6,012,862 A * 1/2000 Nakano et al. ..... 400/625
6,322,068 B1 * 11/2001 Iemura et al. ..... 271/177
6,701,841 B1 * 3/2004 Tsurumaki ..... 101/419
6,752,481 B1 * 6/2004 Takahashi et al. ..... 347/9
2003/0193125 A1 * 10/2003 Saegusa et al. ..... 270/58.08

OTHER PUBLICATIONS

Chinese Office Action for corresponding Chinese Application No. 2003101196389 dated Dec. 2, 2005.

* cited by examiner

*Primary Examiner*—Ren Yan
(74) *Attorney, Agent, or Firm*—Staas & Halsey LLP

(57) ABSTRACT

A paper ejecting mechanism and an ink-jet printer having the paper ejecting mechanism. The paper ejecting mechanism includes an ejecting roller and a star wheel which eject a sheet of paper printed by a printhead into an output tray, and a paper stand installed under the ejecting roller which supports the paper when the ejecting roller is rotated in an ejecting direction, and drops the paper into the output tray when the ejecting roller is rotated in a reverse direction to the ejecting direction.

18 Claims, 5 Drawing Sheets

PAPER EJECTING MECHANISM AND INK-JET PRINTER HAVING THE PAPER EJECTING MECHANISM

CROSS-REFERENCE TO RELATED APPLICATIONS

This application claims the benefit of Korean Patent Application No. 2002-74358, filed on Nov. 27, 2002, in the Korean Intellectual Property Office, the disclosure of which is incorporated herein in its entirety by reference.

BACKGROUND OF THE INVENTION

1. Field of the Invention

An aspect of the present invention relates to a paper ejecting mechanism and an ink-jet printer having the paper ejecting mechanism, and more particularly, to a paper ejecting mechanism, which is driven by an ejecting roller to rotate, supports a sheet of paper in the rotating direction of the ejecting roller, and ejects the sheet of paper when a printing operation is completed, and an ink-jet printer having the ejecting mechanism.

2. Description of the Related Art

FIG. 1 is a cross-sectional view schematically illustrating a conventional feeding and ejection system for an ink-jet printer. An input tray 10 is installed at a rear side of a printer, and a sheet of paper P in the input tray 10 is fed by a pickup roller 11 to a print path. The sheet of paper P fed to the print path is inserted between a feed roller 13 and a pinch roller 14 and enters into a print zone by driving the feed roller 13. The print zone corresponds to a printhead 16 of an ink cartridge 15 in which a printing operation is performed on the paper P. The ink cartridge 15 is mounted on a carriage return frame 17 and moves perpendicular to the print path along a carriage return shaft 18 by way of a driving unit (not shown). A guide 20 which supports the paper P within the print zone flat, is installed below the printhead 16. The printed paper P travels along the print path and is fed between an ejecting roller 21 and a star wheel 23. If the printing operation is completed, the ejecting roller 21 pushes the paper P in a horizontal direction and ejects the paper P into an output tray 30.

However, in the paper ejecting mechanism having the above structure, a front end of the paper P passing the print zone and the ejecting roller is moved downwardly, causing the paper P within the print zone to move up and contact the printhead 16 and to be smeared.

FIGS. 2A and 2B are cross-sectional views illustrating the operation of an ejection system disclosed in U.S. Pat. No. 5,730,537. A sheet of paper 50 placed on an input tray 40 is transferred by a pickup roller 41 and a feed roller 42 into a print zone formed below a printhead 44 of an inkjet cartridge 43 and stays flat on a pivot mechanism 45 for supporting the paper 50. The paper 50 is supported by wings 46 on both sides of a print path while a printing operation is performed on the paper 50. Thus, the paper 50 within the print zone is prevented from lifting up during the printing operation, contacting the printhead 44, and being smeared. Subsequently, the paper 50 on which the printing operation is completed falls into an output tray 49 while the wings 46 move up by way of a cam (not shown). Then, due to an interaction between the pivot mechanism 45 and an arm 48, the paper 50 is pushed into the output tray 49.

However, this ejection system requires an additional cam and a driving source so as to drive the wings 46, which will result in an increase in the number of components, and manufacturing costs increase.

SUMMARY OF THE INVENTION

Accordingly, it is an aspect of the present invention to provide a paper ejecting mechanism in which a wing for supporting a paper is driven by an ejecting roller to be rotated, and an ink-jet printer having the paper ejecting mechanism.

Additional aspects and advantages of the invention will be set forth in part in the description which follows and, in part, will be obvious from the description, or may be learned by practice of the invention.

The foregoing and/or other aspects of the present invention are achieved by providing a paper ejecting mechanism, comprising an ejecting roller which ejects a paper printed on by a printhead in an ejecting direction; and a paper stand installed under the ejecting roller which supports the paper when the ejecting roller is rotated in an ejecting direction, and drops the paper into an output tray when the ejecting roller is rotated in a reverse direction to the ejecting direction.

It is another aspect of the present invention is to provide an ink-jet printer comprising a printing unit to print an image on a paper and a paper ejecting mechanism to support and eject the paper printed by the printing unit.

The paper stand comprises a wing shaft which is parallel to a shaft of the ejecting roller; a wing gear fixed to an outer circumference of the wing shaft and engaged with a gear of the ejecting roller; a wing, an end of which is rotatably connected to the wing shaft and which guides a path of an ejecting paper; and a friction clutch which transmits a rotation force of the wing gear to the wing.

The paper stand further comprises at least one cylindrical member which is rotatably installed on the outer circumference of the wing shaft; and a connection part which extends from the cylindrical member and is connected to the wing.

The friction clutch includes a clutch spring installed between the wing gear and the cylindrical member, and a friction member fixed to the cylindrical member is further provided between the clutch spring and the cylindrical member.

The wing is upwardly inclined at a predetermined angle with respect to the ejecting direction when it supports the paper, and an end of the wing in the ejecting direction is higher than a flat surface formed by a contact side between the ejecting roller and the star wheel.

The wing protrudes downwardly in a direction perpendicular to the ejecting direction.

At least one relay gear is disposed between the ejecting roller and a feed roller such that when the feed roller is rotated in the ejecting direction, the wing is upwardly rotated, and the rotation of the wing is stopped by a first stopper installed inside a printer. When the feed roller is rotated in a reverse direction to the ejecting direction the wing is downwardly rotated, and the rotation of the wing is stopped by a second stopper installed inside the printer.

BRIEF DESCRIPTION OF THE DRAWINGS

These together with other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
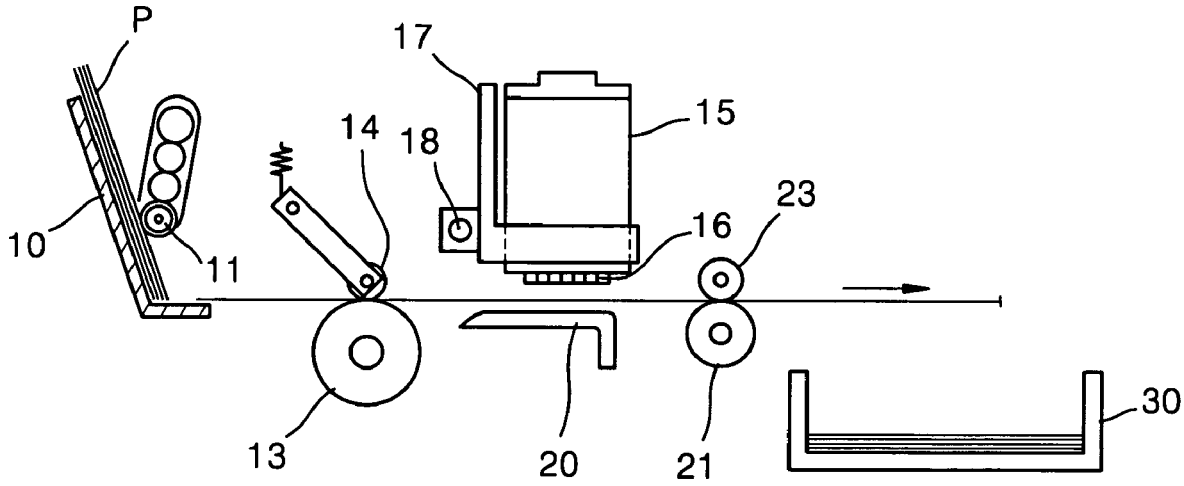
FIG. 1 (PRIOR ART)
FIG. 1 is a cross-sectional view schematically illustrating a conventional feeding and ejection system for an ink-jet printer.
Figure 2A:
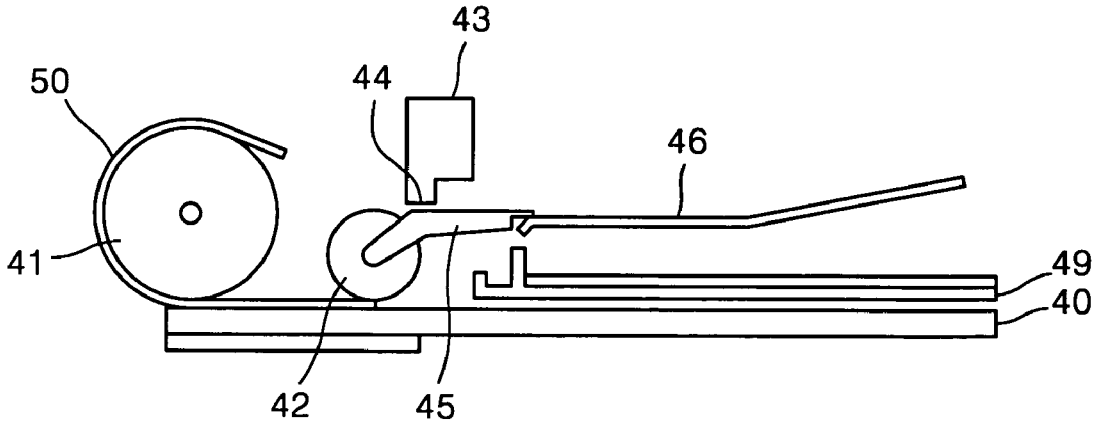
FIG. 2A (PRIOR ART)
FIGS. 2A and 2B are cross-sectional views each schematically illustrating the operation of a conventional ejection system.
Figure 2B:
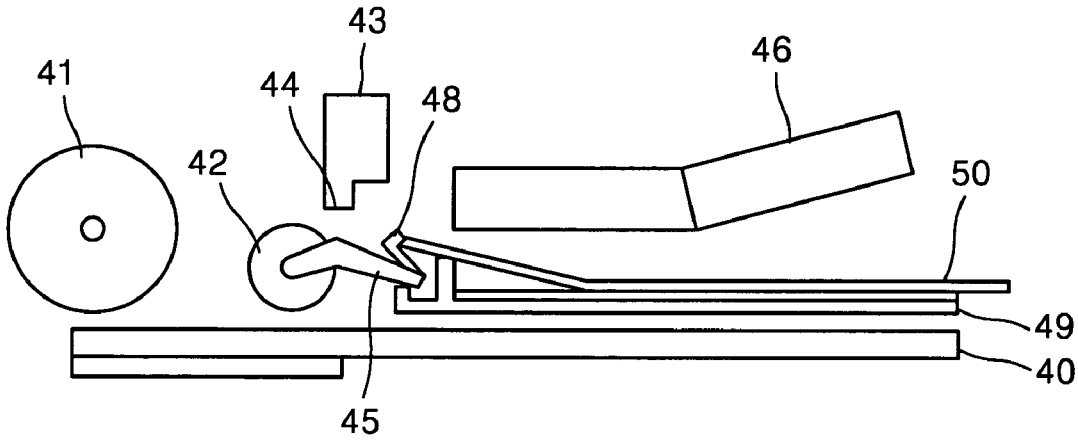
FIG. 2B (PRIOR ART)

Reference will now be made in detail to the present preferred embodiments of the present invention, examples of which are illustrated in the accompanying drawings, wherein like reference numerals refer to the like elements throughout.

Figure 3:
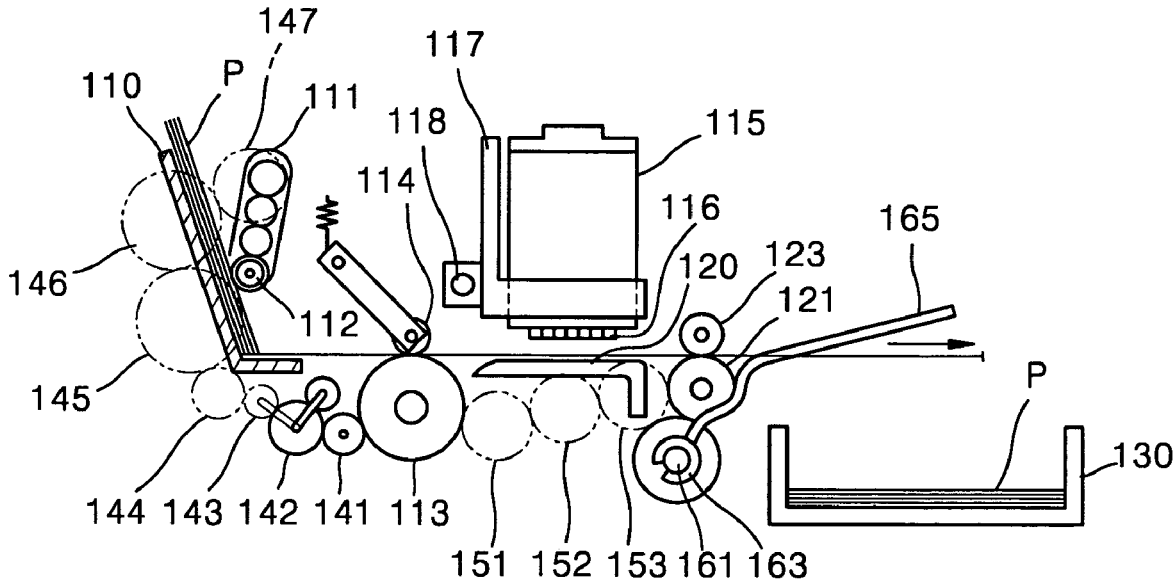
FIG. 3 is a cross-sectional view schematically illustrating an ink-jet printer having a paper ejecting mechanism according to an embodiment of the present invention.
Figure 4:
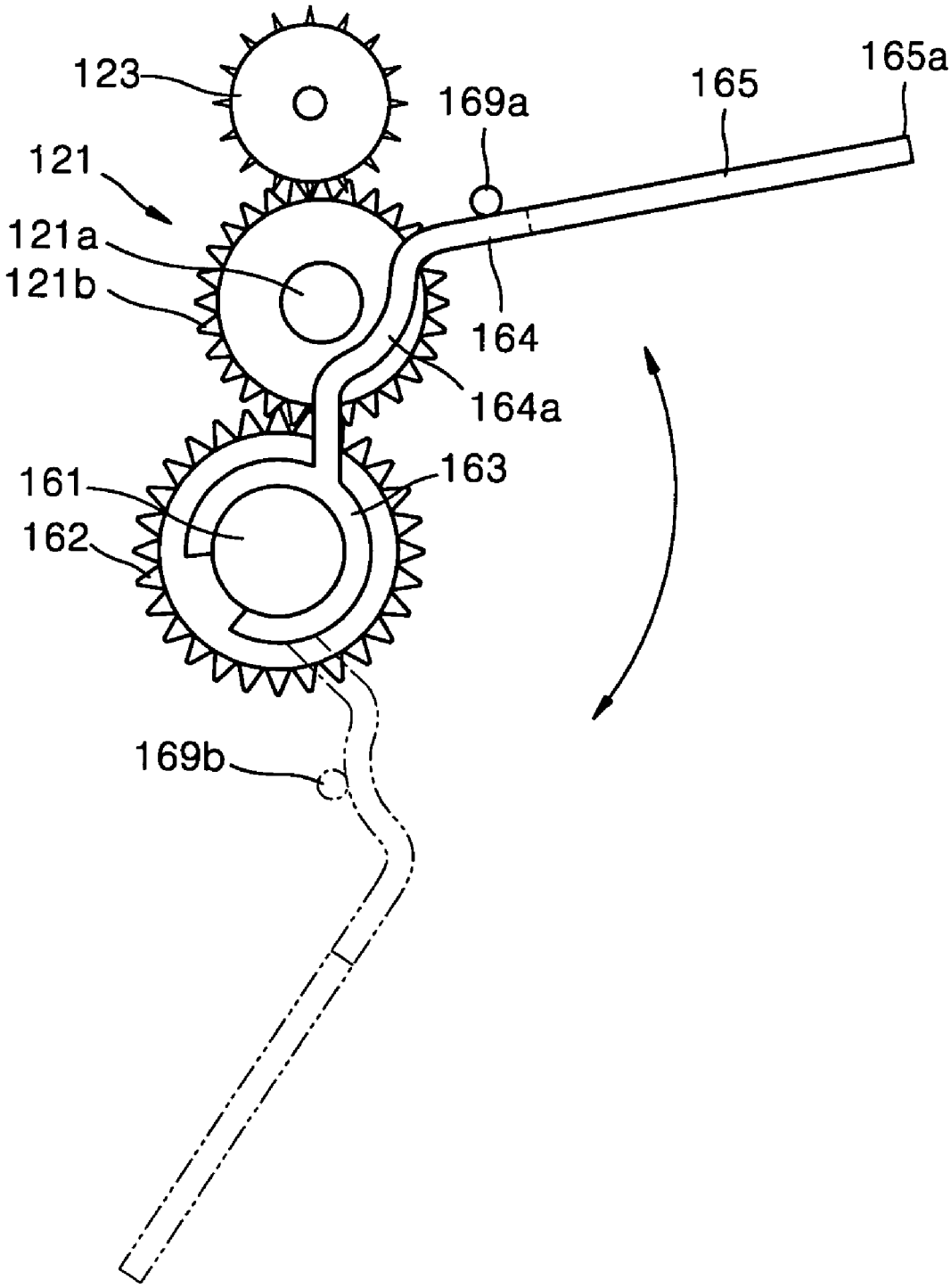
FIG. 4 is a cross-sectional view illustrating the operation of the paper ejecting mechanism shown in FIG. 3.

FIG. 3 is a cross-sectional view schematically illustrating an ink-jet printer having a paper ejecting mechanism according to an embodiment of the present invention, and FIG. 4 is an enlarged view of the paper ejecting mechanism shown in FIG. 3.

Referring to FIG. 3, an input tray 110 on which a sheet of paper P is stacked is installed at a rear side of a printer, and a pickup roller 112 in a pickup roller unit 111 is installed to contact the surface of the sheet of paper P in the input tray 110. A sheet of paper P is supplied by the pickup roller 112 to a print path. A feed roller 113, an ink cartridge 115, and an ejecting roller 121 are sequentially disposed along the print path. A star wheel 123 or other wheel or mechanism may be disposed on the ejecting roller 121 to assist the ejecting roller in ejecting the paper. A paper stand is installed under the ejecting roller 121.

The structure of gears in which the pickup roller 112, the feed roller 113, and the ejecting roller 121 are driven by one driving unit (not shown), the pickup roller 112 is selectively rotated in the rotating direction of the driving unit, and the rotating direction of the ejecting roller 121 is determined by the rotating direction of the driving unit. A gear of the feed roller 113 is rotated by a pinion gear 141 connected to the driving unit and the ejecting roller 121 is rotated by relay gears 151, 152, and 153 disposed between the gear of the feed roller 113 and the ejecting roller 121, and the star wheel 123 is rotated while contacting the ejecting roller 121. In addition, a first gear 142 is connected to the pinion gear 141 in an opposite direction of the ejecting roller 121, and a swing gear 143 is installed on a circumference of the first gear 142 to be rotated by the first gear 142. When the pinion gear 141 is rotated counterclockwise, the swing gear 143 is spaced apart from a pickup roller relay gear 144 by a predetermined gap. When the pinion gear 141 is rotated clockwise, the swing gear 143 is engaged with the pickup roller relay gear 144 along the circumference of the first gear 142 to rotate pickup roller relay gears 145, 146, and 147 and relay gears in the pickup roller unit 111. Thus, the pickup roller 112 is rotated counterclockwise, and a sheet of paper P is fed from the input tray 110 to the print path.

The paper P supplied to the print path is inserted between the feed roller 113 and a pinch roller 114 and enters into a print zone by rotation of the feed roller 113. The print zone corresponds to a printhead 116 of the ink cartridge 115 in which a printing operation is performed on the paper P. The ink cartridge 115 is mounted on a carriage return frame 117 and moves perpendicular to the print path along a carriage return shaft 118 by way of a driving unit (not shown). A guide 120, which keeps the paper P flat within the print zone, is installed below the printhead 116. The printed paper P travels along the print path and is fed between the ejecting roller 121 and the star wheel 123.

Figure 5:
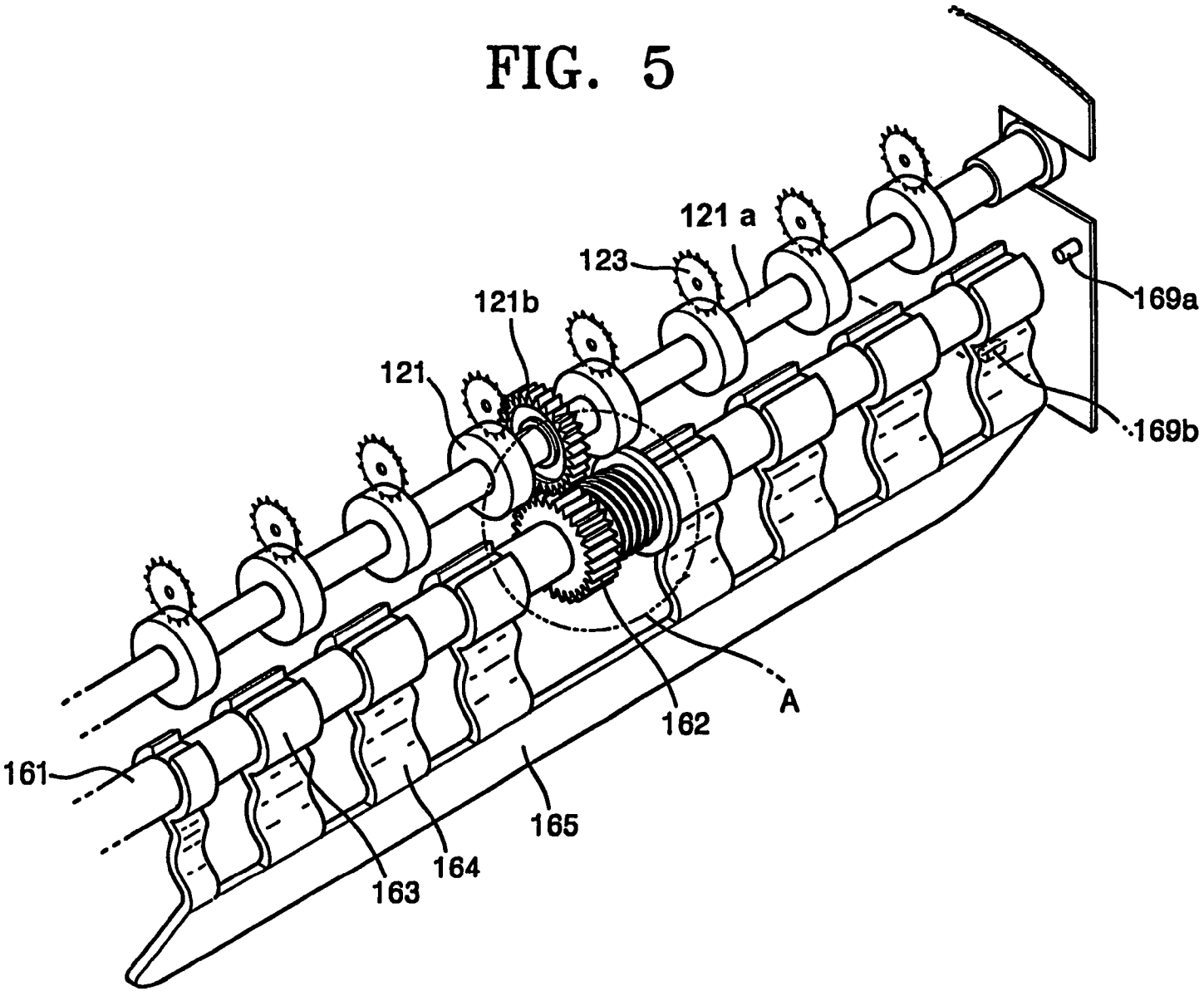
FIG. 5 is a perspective view illustrating a part of a paper stand disposed at the lower limit.

FIG. 4 is a cross-sectional view illustrating the operation of the paper ejecting mechanism shown in FIG. 3, and FIG. 5 is a perspective view illustrating a part of a paper stand disposed at the lower limit.

Referring to FIGS. 4 and 5, a wing shaft 161 is disposed to be downwardly spaced apart from a shaft 121*a* of the ejecting roller 121 by a predetermined distance. A wing gear 162, fixed to an outer circumference of the wing shaft 161, rotates while being engaged with a gear 121*b* of the ejecting roller 121, and a plurality of cylindrical members 163 are rotatably installed on the outer circumference of the wing shaft 161. One side of each cylindrical member 163 may be opened so that the cylindrical members 163 are easily assembled on the wing shaft 161. A wing 165, which guides an ejecting path of the paper P, is connected to one end of connection parts 164 respectively extending from the cylindrical members 163. In addition, the connection parts 164 are inserted between the ejecting rollers 121 and spaced apart from the ejecting roller shaft 121*a* by a predetermined gap so that the wing 165 is disposed adjacent to the ejecting path of the paper P in a position in which the paper P is supported. A portion of the connection part 164 adjacent to the ejecting roller shaft 121*a* forms a convex portion 164*a* along the outer circumference of the ejecting roller shaft 121*a*. The wing 165 may be disposed most adjacent to the ejecting path of the paper P by the convex portion 164*a* of the connection part 164. In addition, the wing shaft 161 is disposed inwardly (left side of FIG. 4) so that the paper P does not contact the cylindrical members 163 when the paper P drops.

The wing 165 is upwardly inclined so that a front end of the paper P is moved upward and the paper P within the print zone is spaced apart from the printhead 116 of FIG. 3. The end 165*a* of the wing 165 is higher than a flat surface of the print zone. In addition, the wing 165 protrudes downwardly in a direction perpendicular to an ejecting direction to support the paper P when dropping paper P into the output tray.

Figure 6:
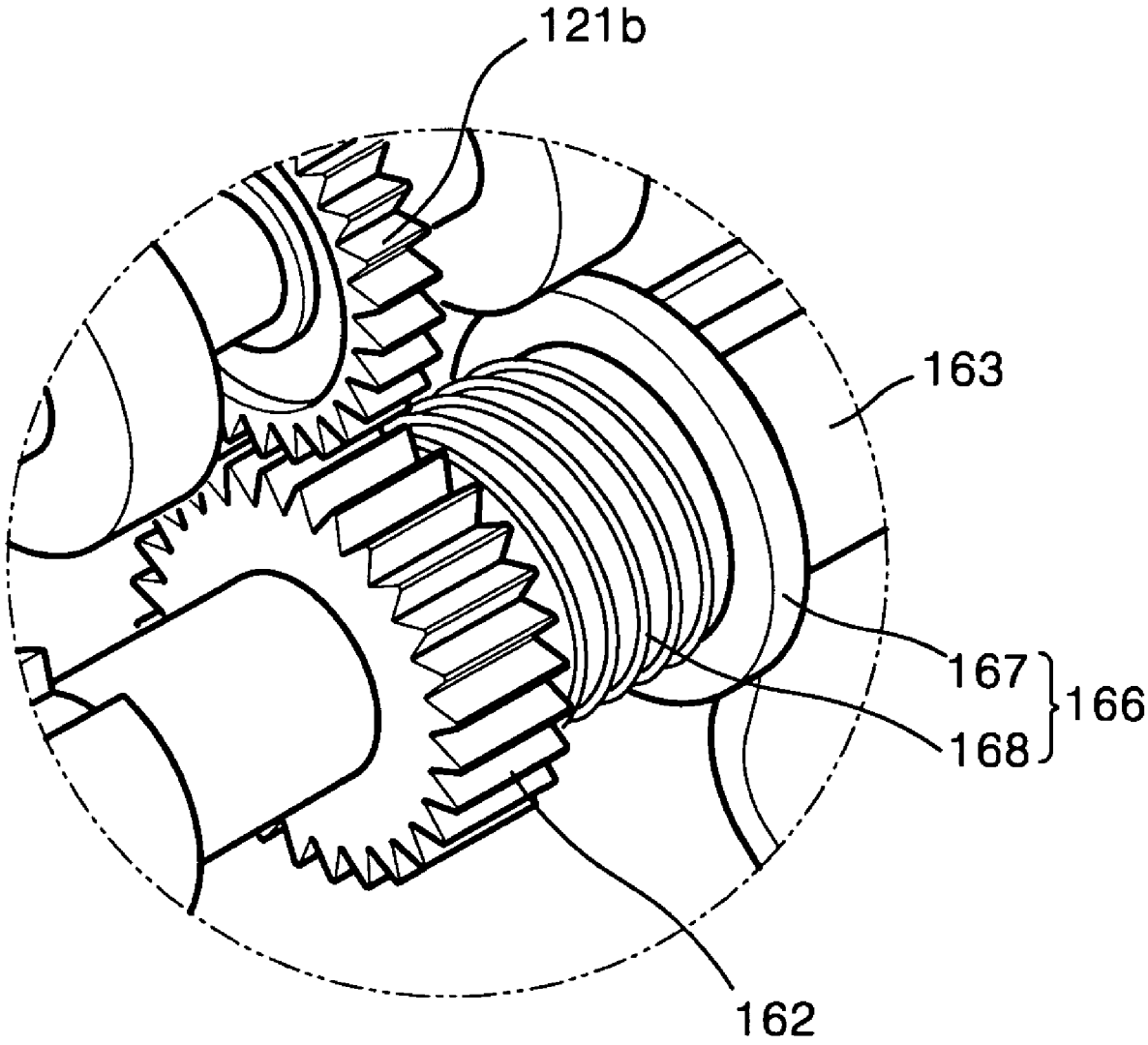
FIG. 6 is an enlarged view of portion A of FIG. 5.

FIG. 6 is an enlarged view of portion A of FIG. 5. Referring to FIGS. 5 and 6, a friction clutch 166 which pivots the wing 165 by converting the rotation force of the wing gear 162 into friction force, is installed between the wing gear 162 and one of the cylindrical member 163. The friction clutch 166 includes a clutch spring 168, one end of which contacts one side of the wing gear 162, and the other end of which contacts a friction member 167 fixed to one side of the cylindrical member 163. The friction member 167 is rotatably installed with the cylindrical member 163. Materials such as rubber or cork may be attached on the surface of the friction member 167 such that it contacts with the clutch spring 168 to increase friction force.

Referring to FIGS. 4 and 5, first and second stoppers 169*a* and 169*b* which confine the position of the rotating wing 165, are installed in a main body of the printer to define the upper and lower limits of the wing 165.

The position of the wing 165 is adjusted by the rotating direction of the ejecting roller 121. The wing 165 is upwardly rotated by the friction clutch 166 and is disposed at the upper limit, when the ejecting roller 121 is rotated in the ejecting direction (clockwise), and guides ejecting of the paper P. In addition, when the ejecting roller 121 is rotated in a reverse direction to the ejecting direction (counterclockwise), the wing 165 moves in a downward direction by the friction clutch 166 and is disposed at the lowest limit. In this case, the wing 165 drops the paper P into an output tray 130.

The operation of an ink-jet printer having the paper ejecting mechanism having the above structure will be described in detail with reference to the accompanying drawings.

When the pinion gear 141 is rotated clockwise by the rotation of the driving unit, the first gear 142 is rotated counterclockwise and the swing gear 143 is rotated counterclockwise on the circumference of the first gear 142; thus the swing gear 143 is engaged with the pickup roller relay gear 144. Subsequently, the relay gears of the pickup roller 112 are rotated, and the pickup roller 112 is rotated counterclockwise. The pickup roller 112 feeds a sheet of paper P into the print path.

Subsequently, when the driving unit is rotated reversely and the pinion gear 141 is rotated counterclockwise, the first gear 142 is rotated clockwise, and the swing gear 143 is rotated clockwise on the circumference of the first gear 142. Thus, the swing gear 143 is spaced apart from the pickup roller relay gear 144 by a predetermined gap, and the pickup roller 112 stops. The paper P is then inserted between the feed roller 113 and the pinch roller 114 and enters into the print zone according to a driving speed of the feed roller 113. The paper P entering into the print zone is horizontally maintained on the guide 120, is printed on by the printhead 116, and travels in the ejecting direction. The ejecting roller 121 is rotated in the ejecting direction, i.e., clockwise, via the feed roller 113 and the plurality of relay gears 151, 152, and 153. The wing gear 162 is rotated counterclockwise by the gear 121*b* of the ejecting roller 121, and the wing gear 162 transmits friction force to the friction member 167 through the clutch spring 168 of the friction clutch 166. Due to the friction force, the cylindrical member 163 fixed to the friction member 167 moves, and the wing 165 is rotated counterclockwise by connection parts 164. The rotation of the wing 165 stops by the first stopper 169*a* installed at the upper limit inside of the printer.

The paper P that is printed on and has passed through the print zone passes between the ejecting roller 121 and the star wheel 123 and travels in the ejecting direction along the wing 165 disposed at the upper limit. The end 165*a* of the wing 165 is upwardly inclined and supports a front end of the paper P upwardly. Thus, a remaining portion of the paper P within the print zone does not lift up, and printing quality is stabilized.

When the a printing operation is completed, the paper P drops into the output tray 130, and as described, the pinion gear 141 is rotated clockwise so as to feed a new paper P into the print path. In this case, the rotating direction of the feed roller 113 and the ejecting roller 121 is reversed, and the wing gear 162 is rotated clockwise. When the wing gear 162 is rotated clockwise, the rotation force of the wing gear 162 is converted into a friction force by the friction clutch 166, and due to the friction force from the clutch spring 168, the friction member 167 and the cylindrical member 163 are rotated. Thus, the wing 165 connected to the cylindrical members 163 is rotated clockwise, and one side of the wing 165 contacts the second stopper 169*b* installed inside the printer to stop the wing 165 at the lowest limit, and the friction clutch 166 runs idle. When the wing 165 is downwardly rotated, the paper P drops into the output tray 130.

As described above, in the paper ejecting mechanism according to an aspect of the present invention, a paper stand is moved to the upper or lowest limit in the rotating direction of an ejecting roller. As a result, at the upper limit, a front end of an ejected paper is moved upward, and a remaining portion of the paper P within a print zone is prevented from lifting up, contacting a printhead, and being smeared. In addition, when the ejecting roller is rotated in a reverse direction to an ejecting direction, the paper stand is moved to the lowest limit, and the paper drops into an output tray. Thus, the paper ejecting mechanism is connected to the ejecting roller without an additional driving source, so manufacturing costs may reduced, and printing quality may improve.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper ejecting mechanism comprising:

an ejecting roller which ejects a paper printed on by a printhead in an ejecting direction; and a paper stand installed under the ejecting roller which supports the paper when the ejecting roller is rotated in an ejecting direction, and drops the paper into an output tray when the ejecting roller is rotated in a reverse direction to the ejecting direction, wherein the ejecting roller comprises:

a gear and a shaft; and the paper stand comprises:

a wing shaft parallel to the shaft of the ejecting roller, a wing gear fixed to an outer circumference of the wing shaft and engaged with the gear of the ejecting roller, a wing, an end of which is rotatably connected to the wing shaft and guides a path of the paper which is ejected, and a friction clutch which transmits a rotation force of the wing gear to the wing.

2. The paper ejecting mechanism of claim 1, wherein the paper stand further comprises:

a cylindrical member which is rotatably installed on the outer circumference of the wing shaft; and a connection part which extends from the cylindrical member and is connected to the wing.

3. The paper ejecting mechanism of claim 2, wherein the wing is upwardly inclined at a predetermined angle with respect to the ejecting direction when supporting the paper.

4. The paper ejecting mechanism of claim 3, wherein an end of the wing in the ejecting direction is higher than a flat surface formed by a contact side of the ejecting roller when supporting the paper.

5. The paper ejecting mechanism of claim 2, wherein the wing protrudes downwardly in a direction perpendicular to the ejecting direction when the paper is dropped into the output tray.

6. The paper ejecting mechanism of claim 1, wherein the friction clutch comprises a clutch spring installed between the wing gear and a cylindrical member.

7. The paper ejecting mechanism of claim 6, wherein the friction clutch further comprises a friction member fixed to the cylindrical member between the clutch spring and the cylindrical member.

8. The paper ejecting mechanism of claim 1, wherein the wing further comprises:

a first stopper is installed at an upper limit of the wing and a second stopper is installed at a lower limit of the wing; the paper ejecting mechanism further comprising:

at least one relay gear disposed between the ejecting roller and a feed roller such that when the feed roller is rotated in the ejecting direction the wing is upwardly rotated, and the rotation of the wing is stopped by the first stopper; and when the feed roller is rotated in a reverse direction to the ejecting direction the wing is downwardly rotated, and the rotation of the wing is stopped by the second stopper.

9. The paper ejecting mechanism of claim 1, further comprising:

a star wheel or other roller or mechanism disposed on the ejecting roller to assist in ejecting the paper printed on by the printhead in the ejecting direction.

10. An ink-jet printer comprising:

a printing unit to print an image on a paper; and a paper ejecting mechanism to support and eject the paper printed on by the printing unit, wherein the paper ejecting mechanism comprises:

an ejecting roller which ejects a paper printed on by a printhead in an ejecting direction; and a paper stand installed under the ejecting roller which supports the paper when the ejecting roller is rotated in an ejecting direction, and drops the paper into an output tray when the ejecting roller is rotated in a reverse direction to the ejecting direction, wherein the ejecting roller comprises:

a gear and a shaft; and the paper stand comprises:

a wing shaft parallel to the shaft of the ejecting roller, a wing gear fixed to an outer circumference of the wing shaft and engaged with the gear of the ejecting roller, a wing, an end of which is rotatably connected to the wing shaft and guides a path of the paper which is ejected, and a friction clutch which transmits a rotation force of the wing gear to the wing.

11. The ink-jet printer of claim 10, wherein the paper stand further comprises:

a cylindrical member which is rotatably installed on the outer circumference of the wing shaft; and a connection part which extends from the cylindrical member and is connected to the wing.

12. The ink-jet printer of claim 11, wherein the wing is upwardly inclined at a predetermined angle with respect to the ejecting direction when supporting the paper.

13. The ink-jet printer of claim 12, wherein an end of the wing in the ejecting direction is higher than a flat surface formed by a contact side of the ejecting roller when supporting the paper.

14. The ink-jet printer of claim 11, wherein the wing protrudes downwardly in a direction perpendicular to the ejecting direction when the paper is dropped into the output tray.

15. The ink-jet printer of claim 10, wherein the friction clutch comprises a clutch spring installed between the wing gear and the cylindrical member.

16. The ink-jet printer of claim 15, wherein the friction clutch further comprises a friction member fixed to the cylindrical member between the clutch spring and the cylindrical member.

17. The ink-jet printer of claim 10, wherein the wing further comprises:

a first stopper installed at an upper limit of the wing and a second stopper installed at a lower limit of the wing; the ink-jet printer further comprising:

at least one relay gear is disposed between the ejecting roller and a feed roller such that when the feed roller is rotated in the ejecting direction the wing is upwardly rotated, and the rotation of the wing is stopped by a first stopper installed inside a printer; and when the feed roller is rotated in a reverse direction to the ejecting direction the wing is downwardly rotated, and the rotation of the wing is stopped by a second stopper installed inside the printer.

18. The ink-jet printer of claim 10, further comprising:

a star wheel or other roller or mechanism disposed on the ejecting roller to assist in ejecting the paper printed on by the printhead in the ejecting direction.

* * * * *